United States Patent [19]

Huntley et al.

[11] 4,032,130

[45] June 28, 1977

[54] DEVICE FOR ASSEMBLING PICTURE FRAMES

[75] Inventors: James R. Huntley; William Franklin Southard, both of Monroe, N.C.

[73] Assignee: Tool Service Engineering Company, Monroe, N.C.

[22] Filed: Jan. 14, 1976

[21] Appl. No.: 649,016

[52] U.S. Cl. ..... 269/8; 269/41; 269/254 R; 269/305

[51] Int. Cl.² ..... B25B 11/00

[58] Field of Search ..... 269/8, 41, 42, 45, 254 R, 269/303, 305, 315, 319

[56] References Cited

UNITED STATES PATENTS

| | | | |
|---|---|---|---|
| 3,307,988 | 3/1967 | Berg | 269/8 |
| 3,590,458 | 7/1971 | Day | 269/41 |
| 3,622,145 | 11/1971 | Gibson | 269/305 |

*Primary Examiner*—Al Lawrence Smith

*Assistant Examiner*—Robert C. Watson

*Attorney, Agent, or Firm*—Bell, Seltzer, Park & Gibson

[57] ABSTRACT

A device for assembling pieces of picture frame molding to form a picture frame therefrom and particularly suited for relatively small "miniature" picture frames which are held together by gluing. The pieces of molding have glue applied to the end portions thereof and are thereafter held in assembled relation at the corners of the frame by respective corner blocks. The corner blocks are supported on a base member, with magnets being employed to permit adjusting the position of the corner blocks on the base member for accommodating pieces of molding of various lengths. Once the pieces of molding are positioned in assembled relation and clamped in place by the corner blocks, one or more elastic bands may be placed around the frame. The thus assembled frame may then be removed from the framing device and placed aside while the glue sets, freeing the framing device for assembling another frame.

10 Claims, 11 Drawing Figures

DEVICE FOR ASSEMBLING PICTURE FRAMES

This invention relates to picture framing, and more particularly to a device and method to facilitate assembling a picture frame from pieces of picture frame molding.

There are many kinds of clamps and vises available for use in making picture frames, however, most are designed for making picture frames of conventional size, and for various reasons are not particularly suited for making relatively small or "miniature" type frames.

For example, conventional size frames are normally secured together either by nails or screws alone, or by nails or screws together with glue. With smaller size frames, it is desirable to secure the same together by glue alone to avoid unsightly nail holes or screw holes, which are more noticeable on the smaller frames. Problems are presented when attempting to use conventional type clamps and vises on relatively small glued frames. For example, the clamps must be left in place on the frame until the glue dries, which limits the rate of production or requires an inventory of a large number of clamps. Additionally, such clamps and vises are cumbersome to use on relatively small frames.

With the foregoing in mind, it is a primary object of the present invention to provide a framing device and method which is particularly well suited for use in assembling relatively small or miniature frames.

It is another object of this invention to provide a device and method particularly suited for assembling frames of the type which may be satisfactorily secured together solely by gluing and without the need for nails or screws.

It is a further object of this invention to provide a device and method which is particularly adapted for assembling a large number of frames by gluing, and wherein inexpensive elastic bands may be used to hold the assembled pieces of picture frame molding in place until the glue dries upon removal of the assembled pieces from the framing device to thereby eliminate the need for a large number of the framing devices.

It is still another object of this invention to provide a device and method of the type described which will accommodate pieces of picture frame molding of various sizes and of a variety of cross sectional shapes.

In accordance with the invention, the pieces of picture frame molding are held in assembled relation at the respective corners of the frame by four corner blocks. The blocks are supported on a base member with magnets being employed to facilitate adjusting the position of the blocks to accommodate pieces of molding of varying length.

The base member has a pair of guide rails thereon extending in right angular relationship, with one of the corner blocks being positioned at the vertex of the angle defined by the guide rails for receiving one of the corners of the frame and with two additional corner blocks being adjustably positioned respectively alongside the guide rails for receiving two additional corners of the frame. The remaining corner block is adjustably positioned on the base member as necessary during assembly of the frame so as to receive the fourth corner of the frame.

Once the pieces of molding are positioned in assembled relation and held in place by the corner blocks, one or more elastic bands may be placed around the frame. The thus assembled frame may then be removed from the framing device and placed aside until the glue dries, leaving the framing device free for assembling additional frames. The framing device and method is useful with a variety of different kinds of molding, including conventional shapes, shell-back, reverse contour, and other ornate shapes.

Some of the objects and features of the invention having been described, others will appear as the description proceeds, when taken in connection with the accompanying drawings, in which FIG. 1 is a perspective view of the framing device of this invention showing a picture frame positioned therein;

Figure 1:
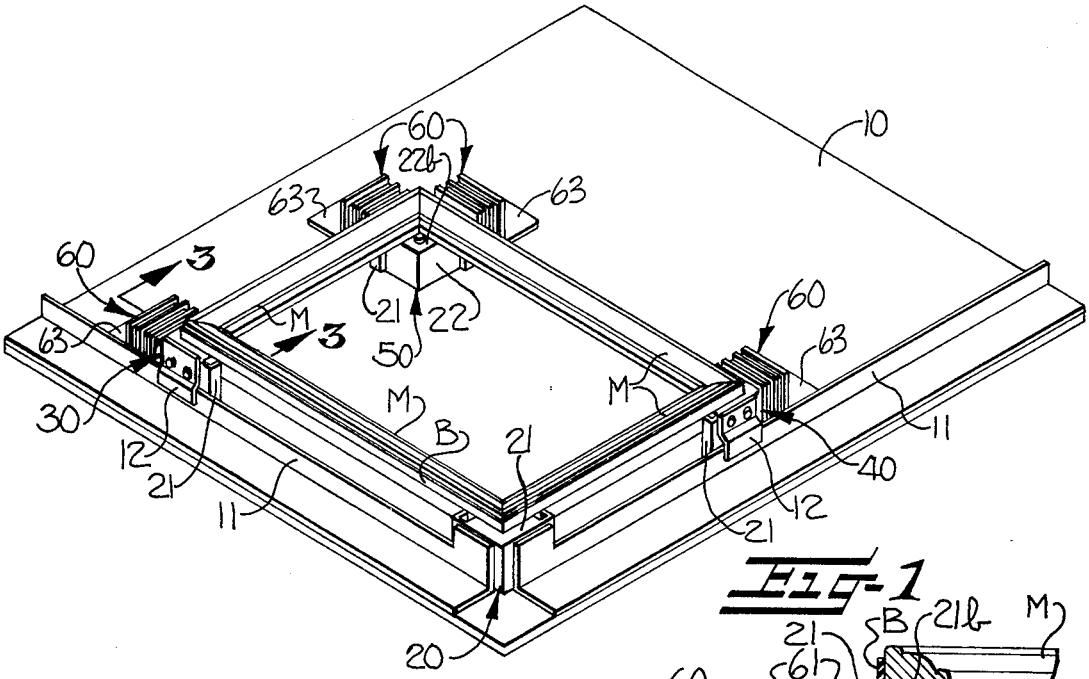

Referring now more particularly to the drawings, the framing device illustrated includes a generally rectangular base member 10 of flat relatively heavy gauge sheet steel having a pair of guide rails 11 formed of angular pieces of sheet metal, welded or otherwise suitably secured to the upper surface of the base member 10. As illustrated, the guide rails 11 extend along two adjacent sides of the base member and are oriented in right angular relationship to one another.

Four corner blocks, generally indicated at 20, 30, 40 and 50, are provided on the upper surface of the base member and positioned so as to receive the respective pieces of picture frame molding therebetween . As illustrated, each corner block has an upper surface adapted for receiving and supporting the pieces of molding M thereon and a pair of flanges extending along the adjacent outer sides of the blocks for engaging the outer side surfaces of the pieces of molding.

One corner block 20 is positioned at the vertex of the angle formed by the guide rails 11 with its outer sides abutting the two guide rails. This corner block need not be secured to the base member 10 since it is held in place against the guide rails when the framing device is in use.

Two of the corner blocks 30 and 40 are positioned respectively alongside the two guide rails 11 and are adapted to be slidably positioned along the guide rails for accommodating pieces of molding of varying length. To insure that the rail corner blocks 30 and 40 remain in abutting relation with the guide rails 11 so as to always form a right angle with respect to the first corner block 20, a clip 12 is preferably provided on each rail corner block 30 and 40 to engage the guide rail 11 and hold the respective corner block in position.

The position of the corner blocks 30 and 40 may thus be slidably adjusted at various positions along the base member, as desired, in accordance with the length of the pieces of molding being assembled. Preferably, to facilitate temporarily securing the corner blocks 30 and 40 at a desired adjusted position on the base member, permanent magnet assemblies, generally indicated at 60, are secured to each of the corner blocks. As illustrated in detail in FIG. 3, each of the permanent magnet assemblies 60 includes a plurality of permanent magnets 61 with steel spacer plates 62 therebetween which engage the surface of the steel base member 10, and with a right angle mounting plate 63 at the outer end of the assembly. A screw or other suitable fastener means 64 secures the mounting plate 63, the magnets 61 and the spacer plates 62 to the corner block.

The fourth corner block 50 is normally positioned diagonally opposite the first corner block 20 and in spaced relation from the guide rails 11 so that the four corner blocks 20, 30, 40 and 50 define the four corners of a rectangle for receiving and positioning the respective pieces of picture frame molding M thereon. The fourth corner block 50 is mounted to the base 10 for sliding movement thereon by a pair of the permanent magnet assemblies 60 secured to the outer sides of the block 50.

Referring more particularly to the corner blocks, it will be seen that all of the blocks are of similar construction. For simplicity, the detailed features of only the first corner block 20 will be described herein. Corresponding detailed features of the remaining corner blocks 30, 40 and 50 will be identified by the same reference characters as to those applied to the block 20.

Figure 3:
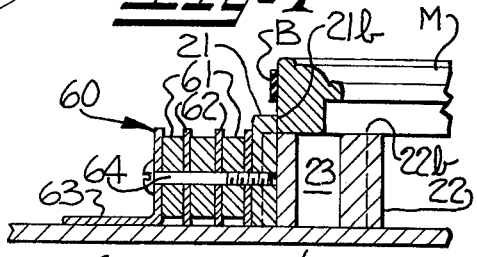
FIG. 3 is a vertical cross-sectional view taken substantially along the line 3—3 of FIG. 1 and showing one of the corner blocks and the magnet assembly associated therewith.
Figure 2:
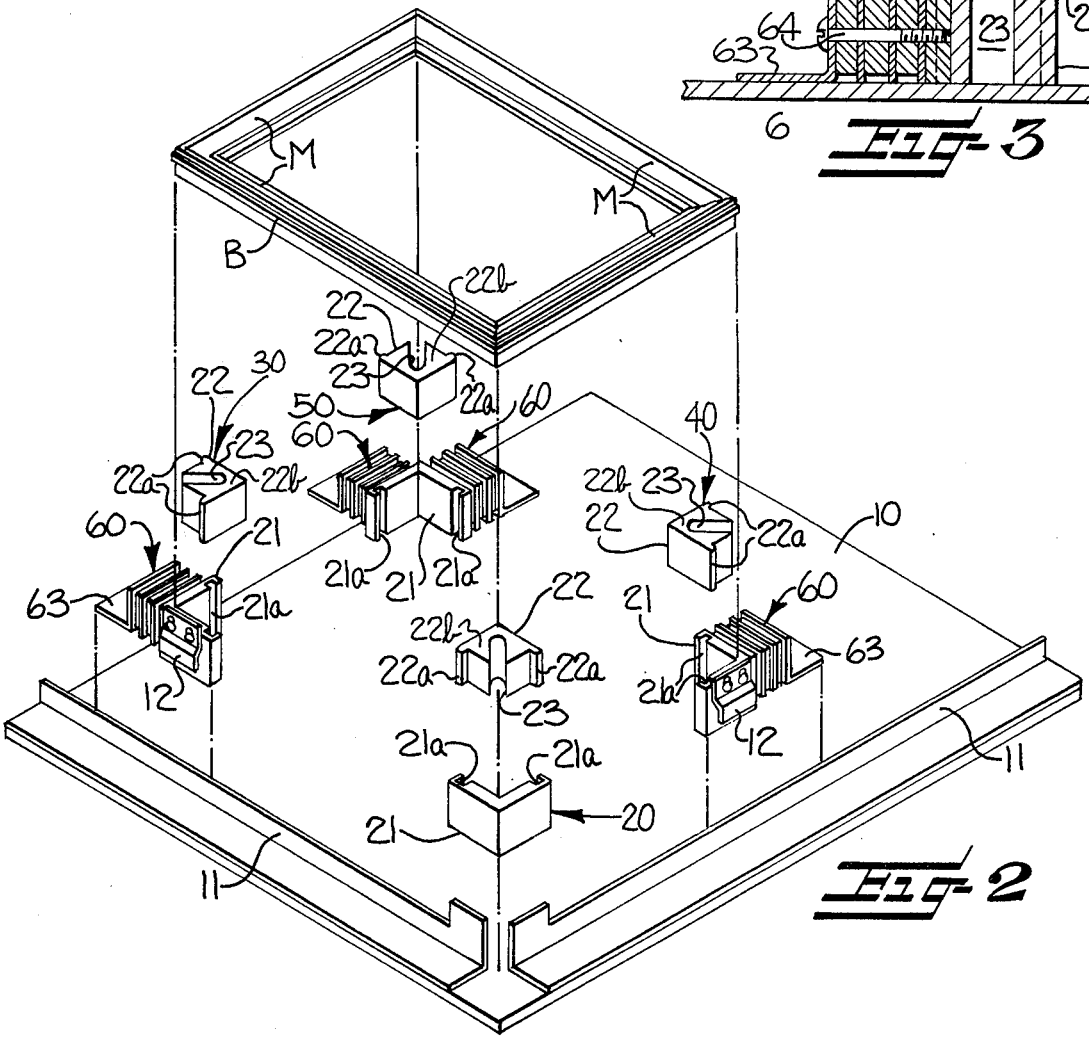
FIG. 2 is a view similar to FIG. 1, but showing the framing device in exploded relation to reveal the various parts thereof.

As best seen in FIG. 2, corner block 20 is formed in two interlocking pieces, preferably from a non-ferrous metal such as an aluminum extrusion. The outer piece 21 of the corner block is a generally L-shaped member to which the magnet assembly 60 is secured. The inner piece 22 is a generally cubical member having a slot-like opening 23 extending diagonally thereacross so as to be positioned beneath the abutting end portions of the pieces of molding for receiving any glue which may drip from the pieces of molding when the pieces are positioned in end abutting relation. The inner piece 22 is removable from the outer piece to facilitate cleaning accumulated glue from the slot-like opening 23. Lugs **22*a* on two opposite corners of the inner piece 22 engage corresponding recesses 21*a* formed in the L-shaped outer piece 21 for interlockingly connecting the two pieces together. As illustrated, the outer piece 21 is somewhat taller than the inner piece 22 and extends above the upper surface of the inner piece a short distance to define a flange 21*b* along the two outer sides of the block 20. Flange 21*b* serves for engaging the outer side surfaces of the pieces of picture frame molding M, while the upper surface 22*b* on the inner piece 22 serves as a supporting surface to support thereon the end portion of the piece of molding above the level of the base member 10. As illustrated in FIG. 3, when pieces of molding M are positioned in the corner block and against the flange 21*b***, portions of the outer side surface of the molding extends above the level of the flange to permit placing of elastic band B around the assembled pieces of picture frame molding for clampingly securing the same together.

Figure 4:
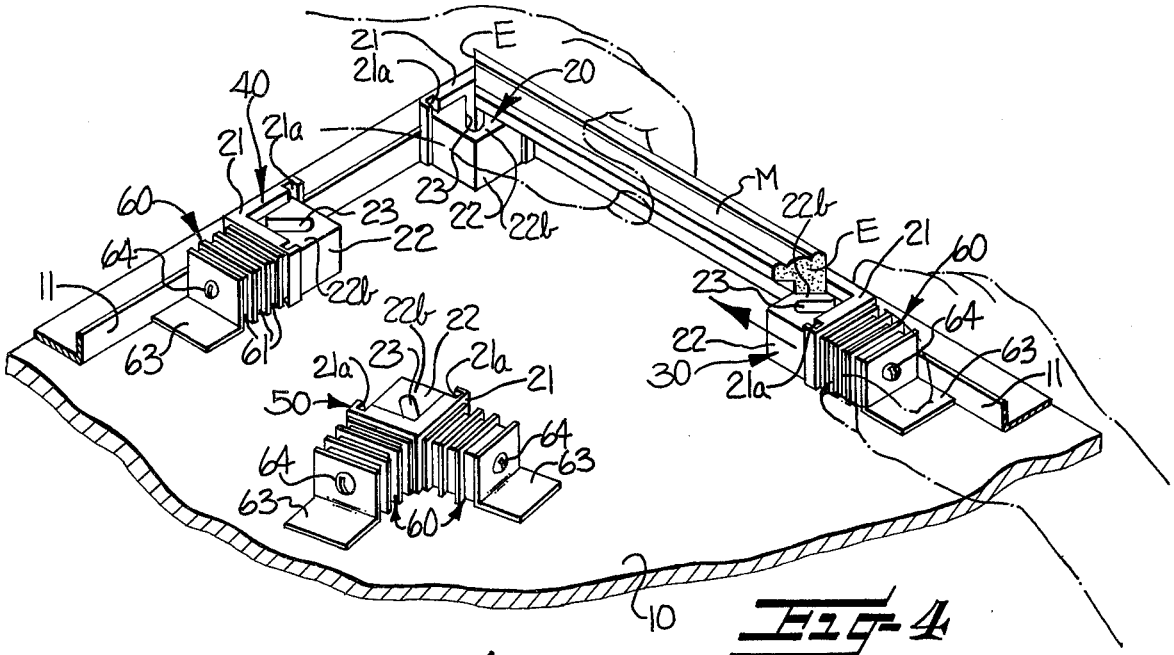
FIGS. 4 to 7 are perspective views illustrating the steps involved in assembling a picture frame in accordance with the method of this invention.
Figure 5:
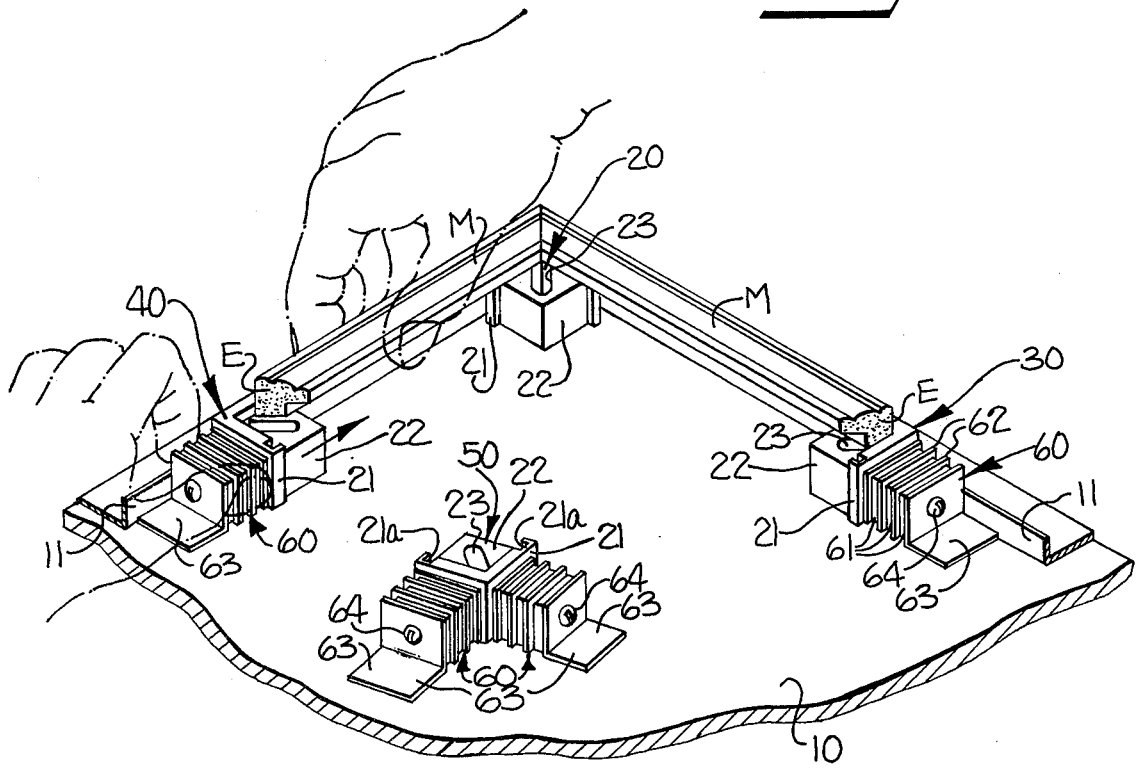
Figure 6:
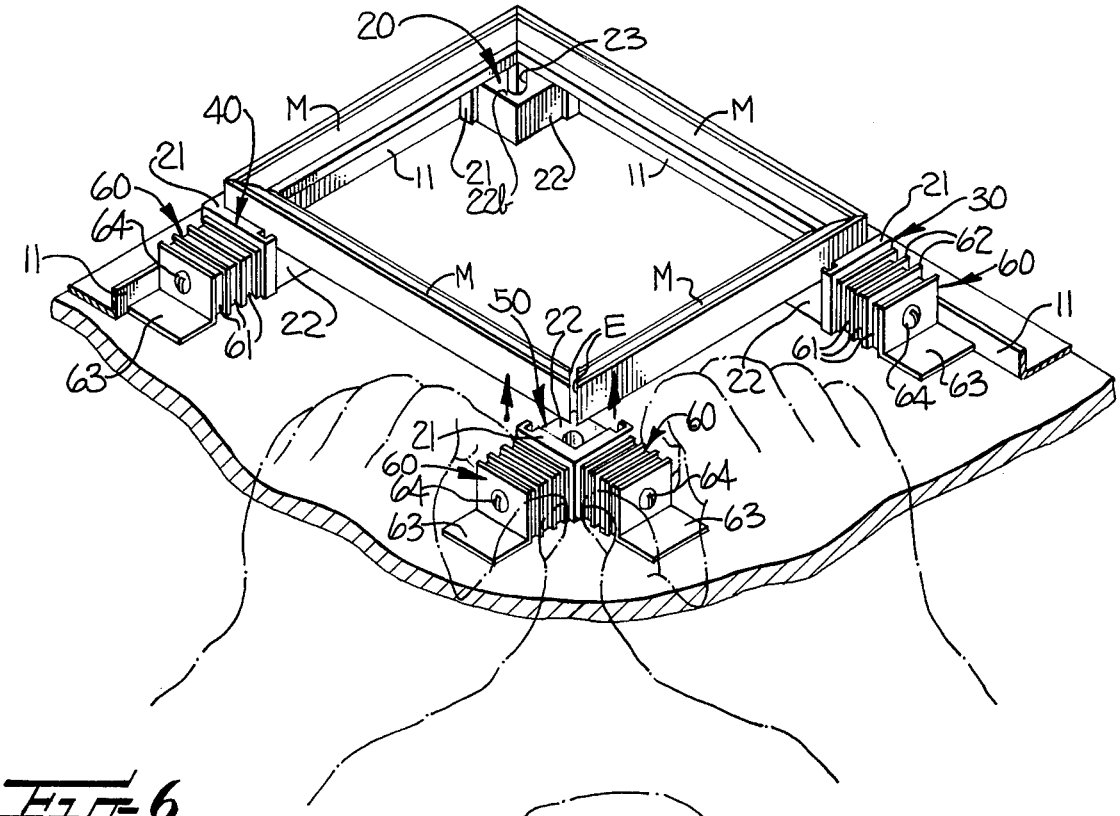

In using the framing device to assemble a picture frame the pieces of molding M are first miter cut to the desired size and glue is applied to the mitered end portions E of the pieces of molding. As illustrated in FIGS. 4 and 5, the two rail corner blocks 30 and 40 are then positioned to capture the two pieces of molding alongside the rails between the rail corner blocks 30 and 40 and the inside corner block 20. The outside corner block 50 is then positioned to approximately the correct location and the two remaining pieces of molding M are positioned, (FIG. 6). Then outside corner block 50, as well as rail corner blocks 30 and 40, if necessary, are adjusted (FIG. 6) to tightly engage the pieces of molding at all four corners and hold the same in correct position. The pieces may then be left in place in the framing device until the glue dries.

Figure 7:
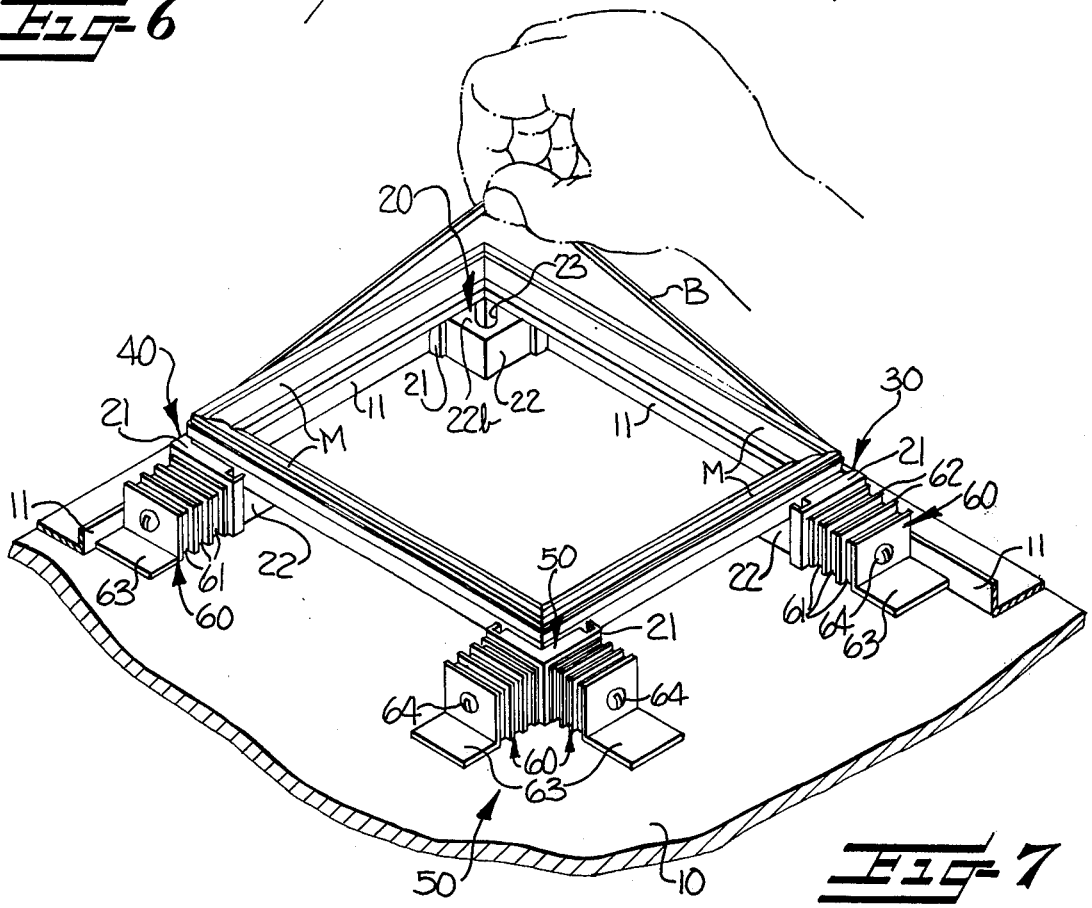

If desired, in order to increase the rate of production, the framing device may be freed for use in making another picture frame before the glue dries on the frame just assembled. This is accomplished by positioning one or more elastic bands B around the outer perimeter of the frame (FIG. 7). With the elastic band in position, the corner blocks may then be loosened to release the frame from the framing device and the assembled frame may be put aside to dry while another frame is being assembled on the framing device.

Depending upon the shape of the molding, it may be necessary to use more than one elastic band to secure the frame together for drying. For example, with shell-back molding it is desirable, after assembly of the frame in the manner just described, to invert the frame and place a second elastic band around the frame from the opposite side.

Certain types of ornate and reverse contour molding have sloping surfaces which will not readily retain elastic bands thereon. To facilitate assembling picture frames from this type of molding, the framing device may be used in the manner illustrated in FIGS. 8–11, with removable corner brackets 70 being employed to receive the elastic bands therearound and help hold the pieces of molding in assembled relation after removal from the framing device. A supply of the corner brackets 70 is provided for use with the framing device.

As illustrated, each corner bracket 70 has an L-shaped base portion 71 with a pair of legs 72 extending from each end of the base portion. The legs have a series of notches 73 formed therein to receive the elastic bands and prevent them from slipping off.

In using the corner brackets, one bracket 70 is positioned alongside each corner block with the base portion 71 positioned against the inside corner of the corner block and with the legs 72 extending upwardly above the upper supporting surface of the respective corner block. After the pieces of molding have had glue applied to the end portions thereof and have been positioned on the corner blocks in assembled relation with the blocks moved into clamping engagement with the molding, one or preferably several elastic bands are positioned around the respective upstanding legs.

Figures 8, 9, 10, 11:
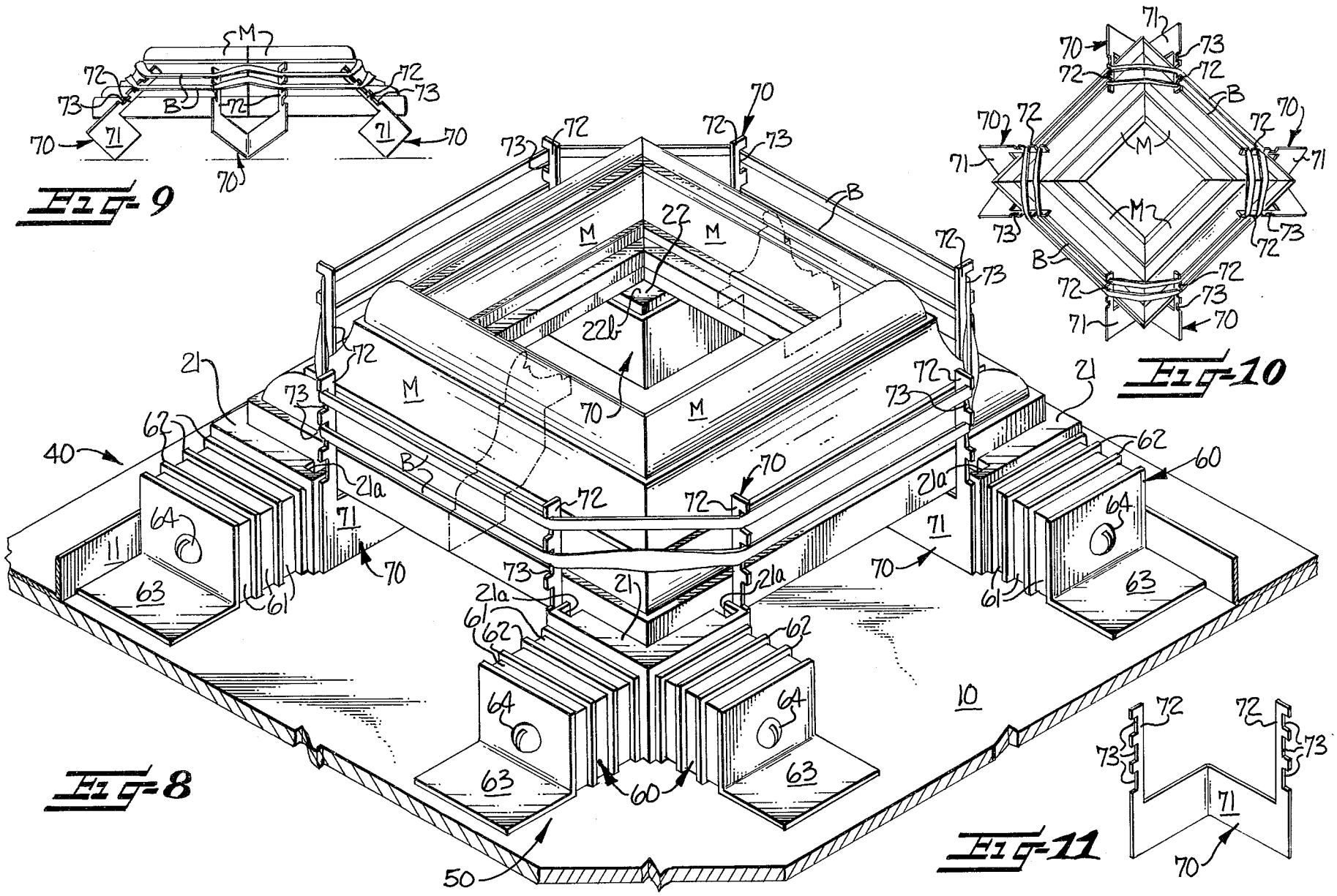
FIG. 8 is a somewhat enlarged perspective view showing the framing device as employed for assembling a picture frame from ornate reverse contour molding, with corner brackets being employed for receiving and holding the elastic bands around the assembled frame.
FIG. 9 is an elevation view showing the picture frame and the corner brackets after the frame has been removed from the framing device.
FIG. 10 is a plan view corresponding to FIG. 9.
FIG. 11 is a detailed perspective view showing one of the corner brackets.

The magnetically held corner blocks may then be moved outwardly to release the assembled frame and permit removal thereof from the framing device. As the assembled frame is removed from the framing device, the elastic bands draw the legs 72 of the corner brackets toward the frame causing the brackets to assume an inclined or tilted position as illustrated in FIGS. 9 and 10. Thus, the pieces of molding are effectively held in properly end-abutting assembled relationship upon removal from the framing device so that the device is ready for assembling another frame using four additional corner brackets while the glue dries on the previously assembled frame.

It will thus be seen that the present invention provides a very useful device and method which may be employed in the assembly of picture frames from pieces of picture frame molding. It should be understood that the terms "glue" and "gluing" are used herein in the generic sense to refer, respectively, to any kind of adhesive substance which may be suitably employed for securing pieces of picture frame molding together, and to the act of securing with any such an adhesive substance.

In the drawings and specifications there have been set forth preferred embodiments of the invention and although specific terms are employed they are used in a generic and descriptive sense only and not for purposes of limitation.

What is claimed is:

1. Apparatus to facilitate the assembly and gluing of pieces of mitered-end picture frame molding to form a picture frame therefrom, said apparatus comprising
- a base member,
- a plurality of corner blocks, one for each corner of the picture frame,
- each of said corner blocks being carried by said base member and having surface portions thereon adapted for receiving and engaging the abutting end portions of a pair of the pieces of molding forming one corner of the picture frame,
- means associated with one of said corner blocks for maintaining the corner block at a predetermined location on said base member whereby the corner block serves to facilitate assembling the initial corner of the picture frame, and
- permanent magnet means cooperating with each of the remaining corner blocks for securing the same to the base member so as to permit adjusting the position of the corner blocks in accordance with the lengths of the pieces of molding to thereby facilitate assembling the remaining corners of the picture frame.

2. Apparatus according to claim 1 wherein each of said corner blocks includes a supporting surface for supporting the pieces of molding thereon and a pair of flanges extending along adjacent outer sides of the block above said supporting surface for engaging the outer side surfaces of the pieces of molding and positioning the same in end abutting relation at a predetermined angle to one another.

3. Apparatus according to claim 2 wherein the flanges along adjacent outer sides of the corner blocks extend above the upper surface of said blocks a short distance so as to leave portions of the outer side surfaces of the pieces of molding exposed for receiving an elastic band thereon.

4. Apparatus according to claim 2 wherein said supporting surface of each of said corner blocks has an opening therein positioned beneath the abutting end portions of the pieces of molding so as to receive excess glue which might drip therefrom and thereby prevent the excess glue from adhering to the exterior surface of the pieces of molding.

5. Apparatus according to claim 4 wherein each of said corner blocks is formed of two interlocking pieces adapted for being separated to facilitate cleaning excess glue therefrom.

6. Apparatus according to claim 1 including a corner bracket positioned adjacent each of said corner blocks, each corner bracket having a pair of upstanding legs adapted for receiving and engaging elastic bands placed therearound for facilitating clamping the pieces of molding together in assembled relation during gluing.

7. Apparatus to facilitate the assembly and gluing of pieces of mitered end picture frame molding to form a picture frame therefrom, said apparatus comprising
- a base member,
- first, second, third and fourth corner blocks, each having surface portions thereon adapted for receiving and engaging the abutting end portions of a pair of the pieces of molding forming one corner of the picture frame,
- said first corner block being positioned at a predetermined location on said base member and being adapted to facilitate forming the first corner of the picture frame,
- guide means cooperating with said second and third corner blocks for guidingly directing the respective corner blocks along predetermined diverging paths extending from the location of said first corner block so as to permit adjusting the position of the second and third corner blocks with respect to said first corner block for accommodating pieces of molding of various lengths therebetween, and
- permanent magnet means cooperating with said fourth corner block for adjustably securing the same to said base member at desired positions thereon in accordance with the lengths of the pieces of molding being assembled so as to receive and engage the respective corner of the picture frame therein.

8. Apparatus according to claim 7 wherein permanent magnet means cooperate with said second and third corner blocks for adjustably securing the same at desired positions on said base member.

9. Apparatus to facilitate the assembly and gluing of pieces of mitered-end picture frame molding to form a picture frame therefrom, said apparatus comprising
- a base member having a planar, generally rectangular upper surface,
- means defining a pair of upstanding guide rails extending along two adjacent sides of the base member and forming a right angle with respect to one another,
- a first corner block located on said base member in abutting relation with said pair of guide rails and adjacent the vertex of the angle formed thereby,
- second and third corner blocks located on said base member respectively alongside said pair of guide rails and in abutting relation therewith so as to form a right angle with respect to said first corner block,
- a fourth corner block located on said base member diagonally opposite said first corner block and in spaced apart relation from said guide rails so that the corner blocks are positioned at four corners of a rectangle,
- each of said corner blocks having a generally planar upper surface located above the level of the base member for supporting the end portions of a pair of the pieces of molding thereon and having a pair of flanges extending along adjacent outer sides of the corner block a short distance above said upper surface for engaging the outer side surfaces of the pieces of molding and positioning the same in assembled end-abutting relation while leaving portions of the outer side surfaces of the pieces of molding exposed for receiving an elastic band therearound, and permanent magnet means cooperating with each of said second, third and fourth corner blocks and with said base member for permitting adjustably positioning the corner blocks at desired locations on the base member for accommodating pieces of molding of various lengths and for securing the corner blocks at such desired locations to hold the corner blocks in clamping engagement with the pieces of molding.

10. Apparatus to facilitate the assembly and gluing of pieces of mitered-end picture frame molding to form a picture frame therefrom, said apparatus comprising a base member having a planar, generally rectangular upper surface, means defining a pair of upstanding guide rails extending along two adjacent sides of the base member and forming a right angle with respect to one another, a first corner block located on said base member in abutting relation with said pair of guide rails and adjacent the vertex of the angle formed thereby, second and third corner blocks located on said base member respectively alongside said pair of guide rails and in abutting relation therewith so as to form a right angle with respect to said first corner block, a fourth corner block located on said base member diagonally opposite said first corner block and in spaced apart relation from said guide rails so that the corner blocks are positioned at four corners of a rectangle, each of said corner blocks having a generally planar upper surface located above the level of the base member for supporting the end portions of a pair of the pieces of molding thereon and having a pair of flanges extending along adjacent outer sides of the corner blocks above said upper surface for engaging the outer side surfaces of the pieces of molding and positioning the same in assembled end-abutting relation;

a removable corner bracket positioned against each of said corner blocks, each corner bracket including a base portion extending alongside the inner sides of the corner block and below the upper surface thereof and a pair of legs extending from said base member upwardly above the upper surface of the corner block and engaging the outer side surfaces of the pieces of molding positioned in the corner block, the upwardly extending legs of the respective corner brackets serving to clampingly secure the pieces of picture frame molding in assembled relation when elastic bands are positioned around the collective legs, and permanent magnet means cooperating with each of said second, third and fourth corner blocks and with said base member for permitting adjustably positioning the corner blocks at desired locations on the base member for accommodating pieces of molding of various lengths and for securing the corner blocks at such desired locations to hold the corner blocks in clamping engagement with the pieces of molding.

* * * * *